US007657215B2

(12) United States Patent
Yamazaki

(10) Patent No.: US 7,657,215 B2
(45) Date of Patent: Feb. 2, 2010

(54) IMAGE FORMING APPARATUS WITH A CLEANING MECHANISM TO COLLECT TONER FOR A FIXING DEVICE

(75) Inventor: Hajime Yamazaki, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 476 days.

(21) Appl. No.: 11/594,997

(22) Filed: Nov. 9, 2006

(65) Prior Publication Data

US 2007/0116500 A1 May 24, 2007

(30) Foreign Application Priority Data

Nov. 11, 2005 (JP) ..... 2005-328175

(51) Int. Cl.
*G03G 15/20* (2006.01)

(52) U.S. Cl. ..... 399/327

(58) Field of Classification Search ..... 399/43, 399/67, 71, 75, 88, 90, 327
See application file for complete search history.

(56) References Cited

U.S. PATENT DOCUMENTS

| | | | | |
|---|---|---|---|---|
| 5,491,506 | A | 2/1996 | Yagishita | |
| 5,508,729 | A | 4/1996 | Yamazaki | |
| 5,865,121 | A | 2/1999 | Testardi et al. | |
| 6,181,890 | B1 | 1/2001 | Kataoka et al. | |
| 6,385,412 | B1 * | 5/2002 | Sadakuni | 399/75 |
| 6,718,155 | B2 * | 4/2004 | Kaji et al. | 399/327 |
| 6,991,308 | B2 | 1/2006 | Yamazaki | |
| 7,190,914 | B2 * | 3/2007 | Nihonyanagi et al. | 399/67 |
| 7,299,001 | B2 * | 11/2007 | Yamazaki | 399/327 |
| 2003/0137578 | A1 | 7/2003 | Yamazaki | |
| 2005/0031360 | A1 | 2/2005 | Yamazaki | |
| 2005/0100371 | A1 | 5/2005 | Yamazaki | |

FOREIGN PATENT DOCUMENTS

| | | |
|---|---|---|
| EP | 0 892 322 | 1/1999 |
| JP | 3-171184 | 7/1991 |
| JP | 07-104602 | 4/1995 |
| JP | 2000-075750 | 3/2000 |
| JP | 2005-107507 | 4/2005 |

OTHER PUBLICATIONS

Office Action dated Mar. 23, 2007 for corresponding European Application No. 06023332.7.

* cited by examiner

*Primary Examiner*—William J Royer
(74) *Attorney, Agent, or Firm*—Harness, Dickey & Pierce, P.L.C.

(57) ABSTRACT

An image forming apparatus includes a fixing device in which a cleaning mechanism for collecting toner left on a heat roller is arranged. When a preselected number of prints are output after the end of a printing job, a cleaning operation for cleaning the heat roller is executed. When a power-supply OFF request arrives while the cleaning operation is under way, a power-supply OFF operation is postponed until the cleaning operation ends.

6 Claims, 10 Drawing Sheets

IMAGE FORMING APPARATUS WITH A CLEANING MECHANISM TO COLLECT TONER FOR A FIXING DEVICE

PRIORITY STATEMENT

This application claims benefit of priority under 35 U.S.C. § 119 from Japanese Patent Application No. 2005-328175 filed on Nov. 11, 2005, in the Japanese Patent Office, the disclosure of which is incorporated herein by reference in its entirety.

BACKGROUND OF THE INVENTION

1. Field of the Invention

The present invention relates to a fixing device for use in a copier, facsimile apparatus, printer or similar electrophotographic image forming apparatus and more particularly to control over power supply for a cleaning mechanism configured to remove toner deposited on a heat roller included in a fixing device.

2. Description of the Background Art

While a fixing device included in an image forming apparatus is configured to fix a toner image on a sheet or recording medium with a heat roller, it is likely that part of the toner image is not fixed on the sheet, but is deposited on a peeler adapted for peeling off the sheet from the heat roller. The toner thus deposited on the peeler is apt to form lumps and suddenly drop onto the heat roller, smearing successive sheets. In order to solve this problem, the fixing device is usually provided with a cleaning mechanism for removing the toner deposited on the heat roller.

On the other hand, energy-saving schemes have recently been applied to various kinds of apparatuses in order to cope with environmental problems. An image forming apparatus, for example, is required to immediately turn off power supply as soon as a printing operation ends after fixing a toner image on a sheet. However, because the cleaning mechanism of the fixing device is configured to clean the heat roller after a printing operation, as stated previously, turning off power supply immediately after a printing operation causes the cleaning operation to be interrupted halfway or practically prevented from being executed.

Technologies relating to the present invention are disclosed in, e.g., Japanese Patent Laid-Open Publication No. 07-104602 and Japanese Patent No. 3,514,134.

SUMMARY OF THE INVENTION

It is an object of the present invention to provide a fixing device including a cleaning mechanism capable of surely cleaning a heat roller and an image forming apparatus including the same.

It is another object of the present invention to provide a fixing device capable of controlling the ON/OFF of power supply for .the above cleaning mechanism and an image forming apparatus including the same.

An image forming apparatus, including a fixing device including a cleaning mechanism configured to collect toner left on a heat roller, of the present invention includes a deciding circuit for determining that a preselected number of prints are output after a printing job and a control unit for controlling a power-supply OFF operation in response to a power-supply OFF request. When the deciding circuit determines that a cleaning operation for the heat roller should be executed, the control unit postpones the power-supply OFF operation indicated by the power-supply OFF request generated during the cleaning operation until the cleaning operation ends.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
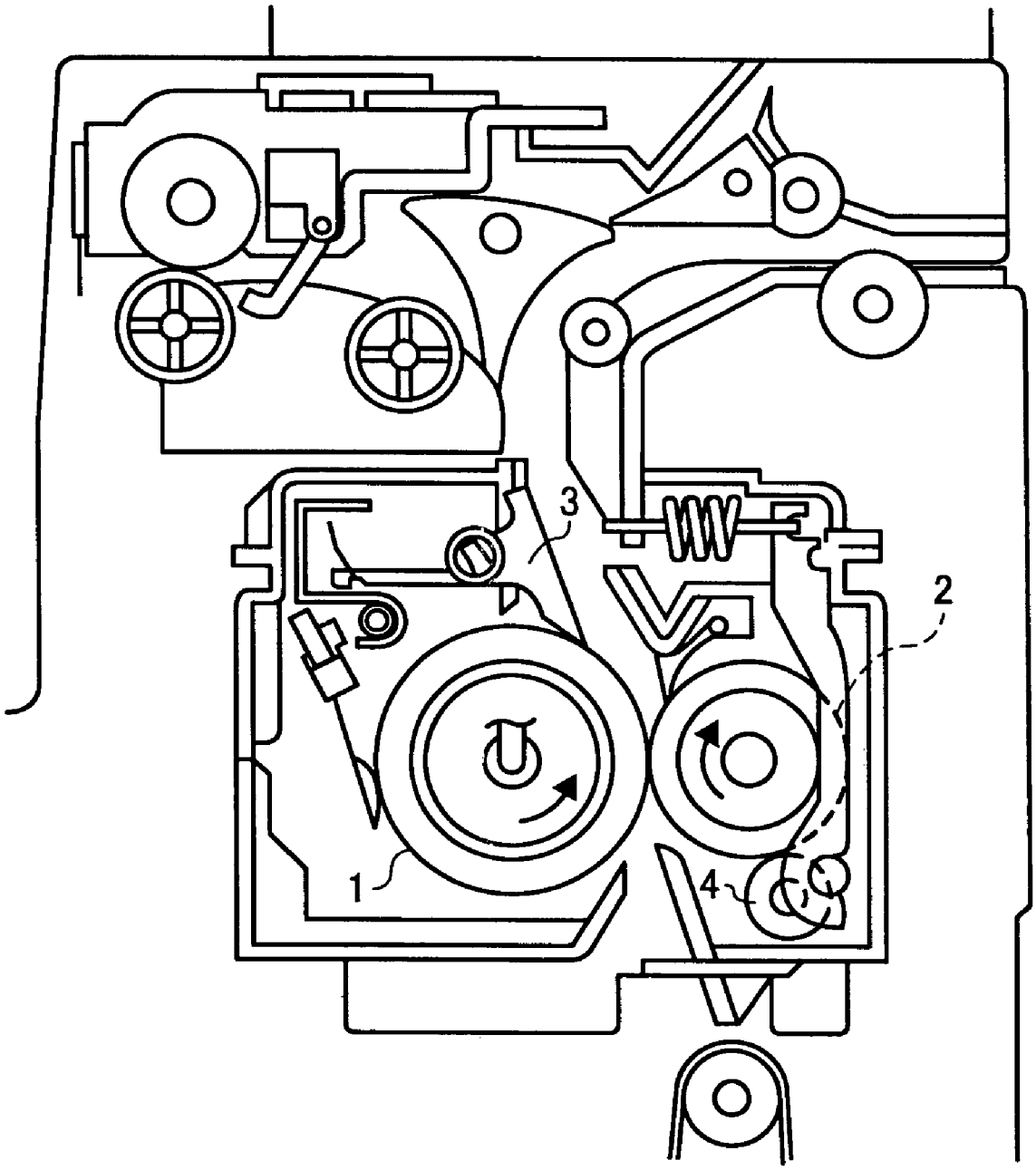
FIG. 1 is a view showing a fixing device included in an image forming apparatus to which the present invention is applied.

To better understand the present invention, a fixing device including a cleaning mechanism for cleaning a fixing roller will be described with reference to FIG. 1. As shown, the fixing device includes a heat roller 1 for fixing a toner image on a sheet or recording medium, a press roller 2 for pressing the sheet against the heat roller 1 and a peeler 3 for peeling off the sheet from the heat roller 1. A cleaning roller 4 constitutes a cleaning mechanism for cleaning the surface of the heat roller 1.

The problem with the above fixing device is that when toner on consecutive sheets, sequentially introduced in the fixing device, are deposited on the peeler 3 in a certain amount, it suddenly drops on the heat roller 1 in lumps and smears the following sheets, as stated previously. In light of this, the lumps of toner dropped from the peeler 3 on the heat roller 1 are collected by the cleaning roller or cleaning mechanism 4 by way of the press roller 2.

Figure 2:
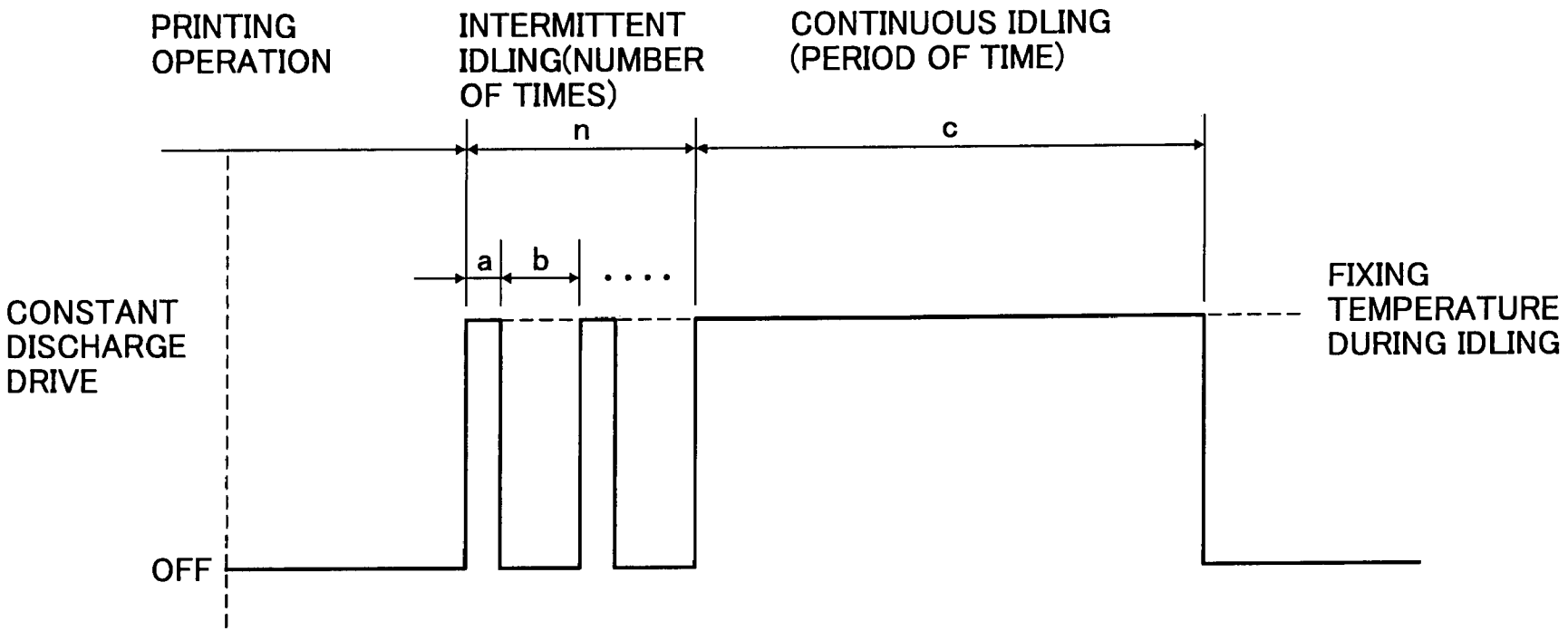
FIG. 2 is a timing chart showing a specific cleaning operation of the fixing device shown in FIG. 1.

FIG. 2 is a timing chart demonstrating the operation of an image forming apparatus, including the cleaning operation of the fixing device shown in FIG. 1. As shown, the heat roller 1 is repeatedly turned on for a period of time of a and turned off for a period of time of b n consecutive times in order to physically cause toner deposited on the peeler 3, FIG. 1, to drop, and then the toner is collected by the cleaning roller 4 within a period of time of c during continuous rotation. The periods of time a, b and c and the number of times n may be variable in accordance with the cleaning effect. Such a cleaning operation should preferably be effected after a printing operation in order to guarantee expected print productivity.

Figure 3:
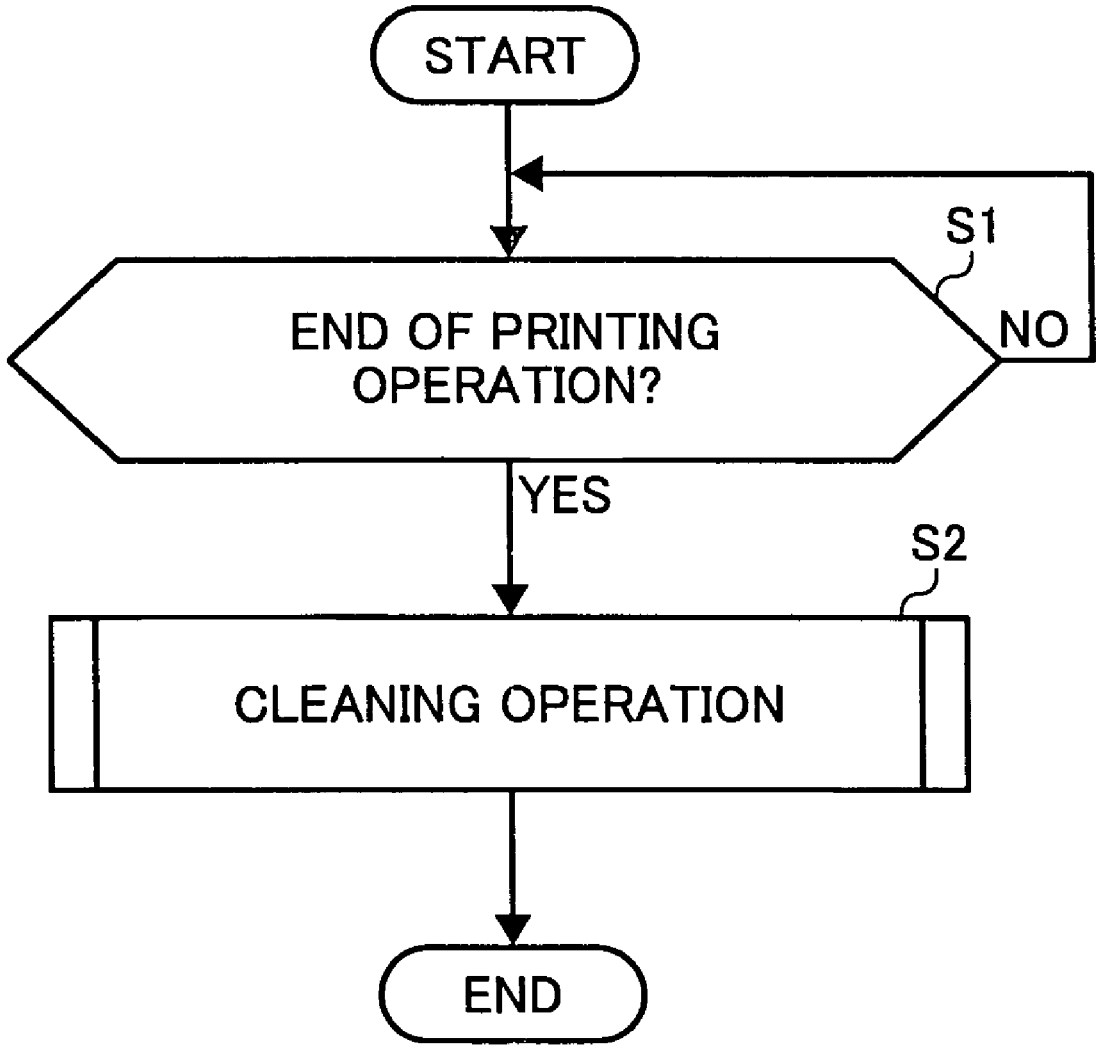
FIG. 3 is a flowchart demonstrating a basic cleaning operation to be executed by the fixing device of FIG. 1.

FIG. 3 is a flowchart showing the basic cleaning operation of the fixing device. As shown, when a printing operation is ended (YES, step S1), the fixing device is caused to effect a cleaning operation (step S2). If the printing operation is not ended (NO, step Si), then the procedure returns to step S1.

In order to save energy, it is a common practice to turn off power supply as soon as a printing operation ends after the fixation of a toner image on a sheet. This brings about a problem that the operation of the cleaning mechanism 4 assigned to the heat roller 1 is interrupted or practically prevented from being executed. Preferred embodiments of the image forming apparatus in accordance with the present invention, which are free from the above problem, will be described hereinafter.

Figure 4:
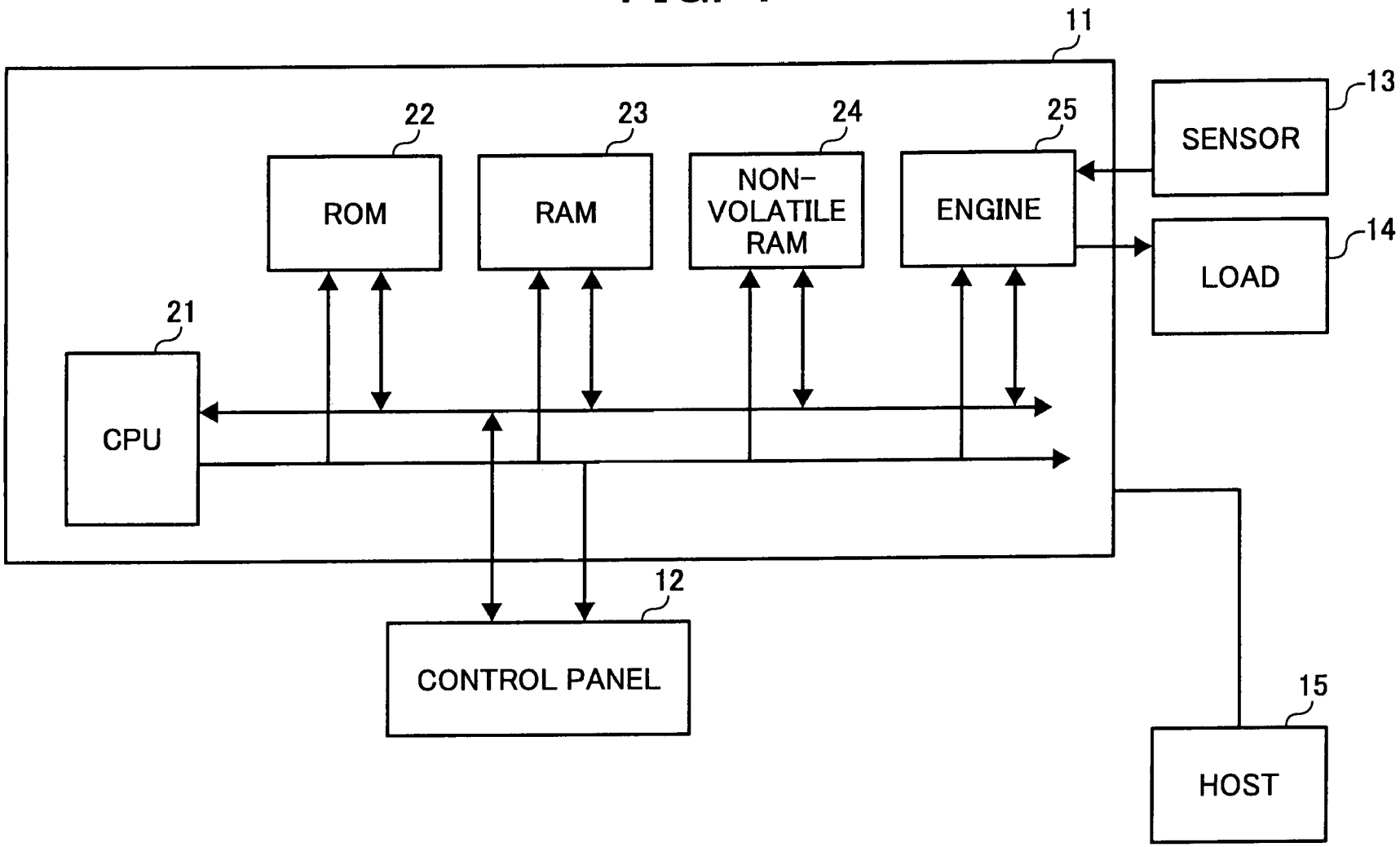
FIG. 4 is a view showing an image forming apparatus with which preferred embodiments of the present invention are practicable.

FIG. 4 is a schematic block diagram showing an image forming apparatus with which the illustrative embodiments of the present invention are practicable. As shown, the image forming apparatus includes a control unit 11, a control panel 12, a sensor 13 and a load 14. The control unit 11 is connected to an external host 15 via a host interface.

The control unit 11 includes a CPU (Central Processing Unit) 21, a ROM 22 (Read only Memory) storing a program for operating the CPU 21, a work RAM (Random Access Memory) 23 assigned to the program, a nonvolatile RAM 24 and an engine 25. The nonvolatile RAM 24 is adapted to store control, timing and other adjustment values and a registered copy mode and is capable of holding such data even when power supply is turned off. The engine 25 is configured to control the load 14 and so forth in accordance with the output of the sensor 13. A print counter for counting prints up to a preselected number is assigned to the nonvolatile RAM 24. The fixing device corresponds to the engine 25.

In the image forming apparatus having the above configuration, when a power-supply OFF request is generated while a cleaning operation is under way, power supply is not turned off until the cleaning operation ends so as not to degrade the cleaning effect.

Figure 5:
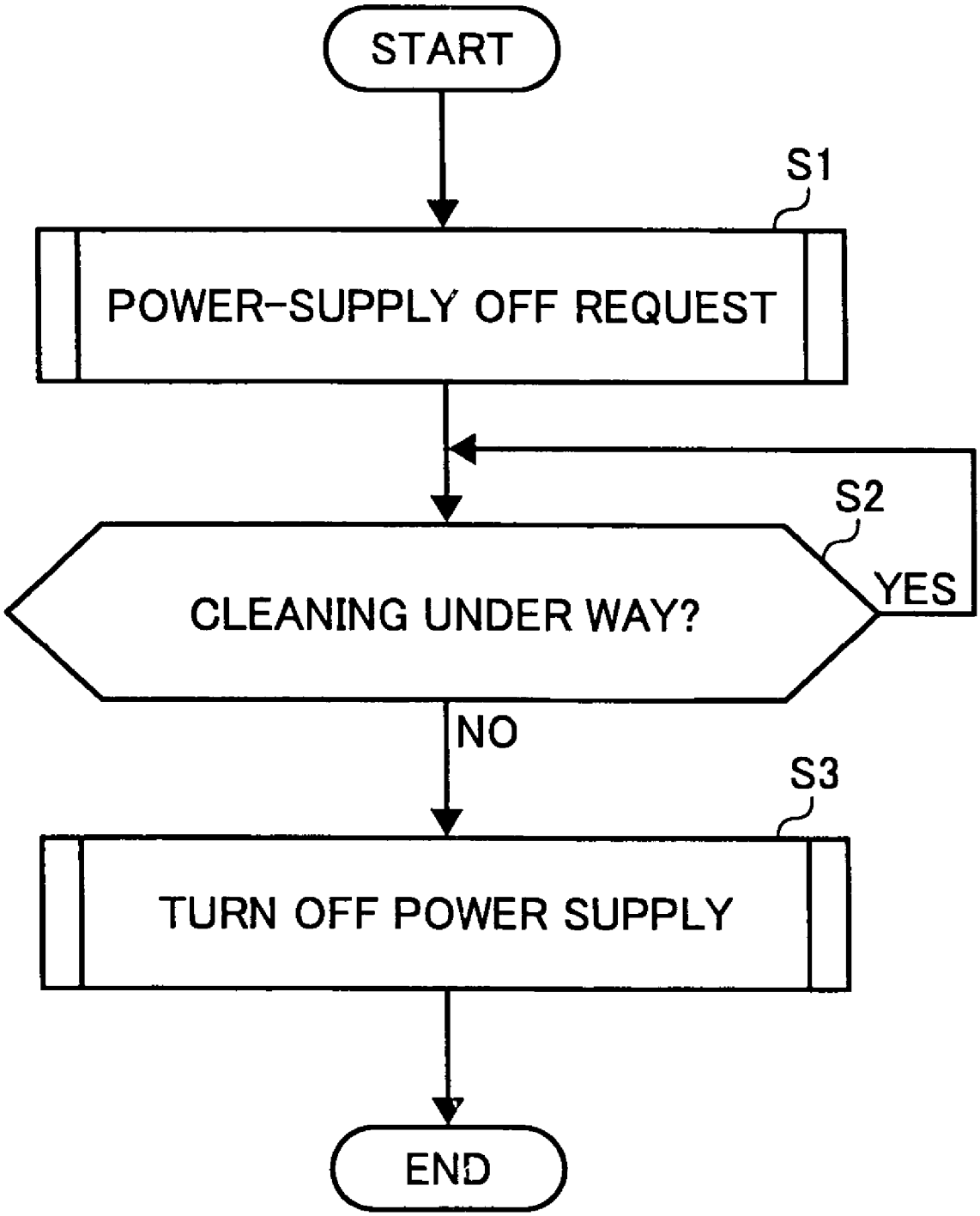
FIG. 5 is a flowchart demonstrating a basic cleaning operation particular to the fixing device in accordance with the present invention.

FIG. 5 is a flowchart demonstrating the basic cleaning operation of the fixing device included in the image forming apparatus of the present invention. As shown, when a power-supply OFF request is generated (step S1), whether or not a cleaning operation is under way is determined (step S2). If a cleaning operation is not under way (NO, step S2), then power supply is turned off (step S3). If a cleaning operation is under way, (YES, step S2), step S2 is repeated.

The illustrative embodiments of the image forming apparatus in accordance with the present invention will be described specifically hereinafter.

Figure 6:
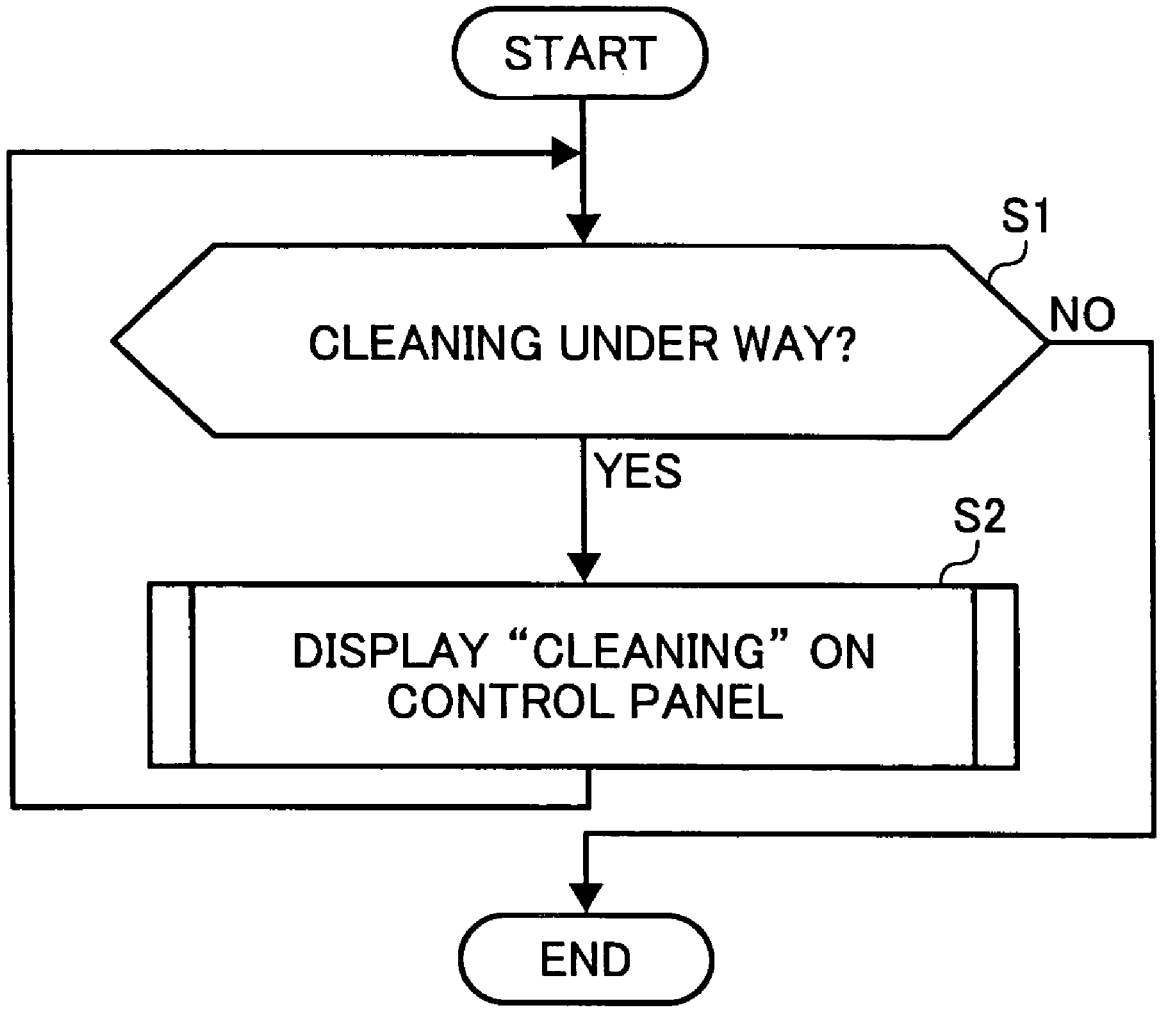
FIGS. 6 through 10 are flowcharts showing specific cleaning procedures representative of a first to a fifth embodiment of the present invention.

FIG. 6 is a flowchart showing a cleaning operation executed in a fixing device included in a first embodiment of the present invention. As shown, when a power-supply OFF command is generated while a cleaning operation is under way (YES, step S1), a suitable message, e.g., "Cleaning" is displayed on the control panel 12 (step S2). Should power supply be not immediately turned off despite the generation of the power-supply OFF request, the operator would feel uneasy.

Figure 7:
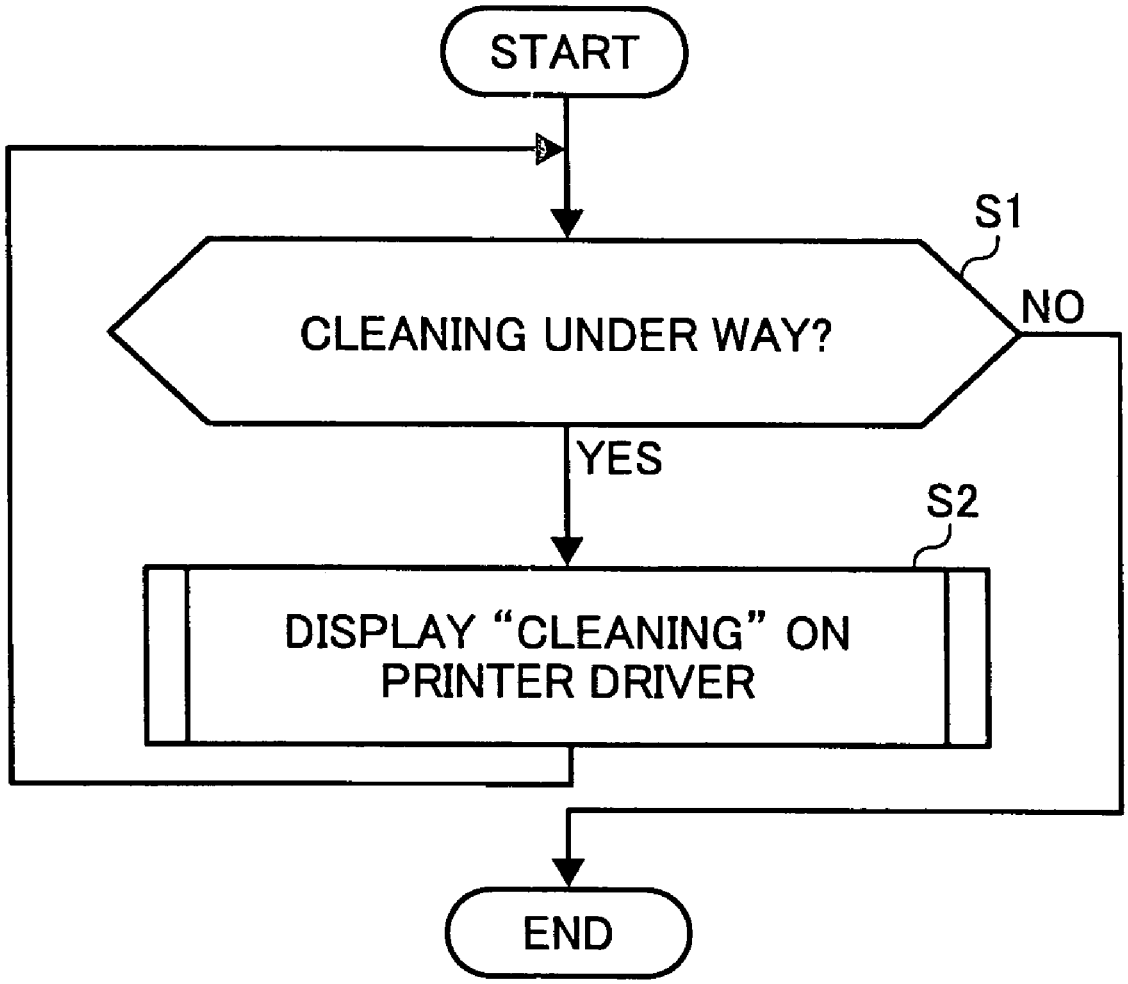

FIG. 7 is a flowchart showing a cleaning operation executed in a fixing device included in a second embodiment of the present invention. As shown, when a cleaning operation is under way (YES, step S1), a printer driver, e.g., a message. "Cleaning" is displayed by use of a printer utility on the host 15 (step S2). This allows the user to confirm the current state of the image forming apparatus via a network, i.e., without actually moving to a position where the control panel 12 is visible.

The object of the present invention is to cause the fixing device to surely perform a cleaning operation, so that power supply is basically not turned off while a cleaning operation is under way. However, it is sometimes more practical to immediately stop a cleaning operation and turn off power supply in response to a power-supply OFF request. More specifically, because whether or not to accept the power-supply OFF request generated during cleaning is considered to be dependent on the source output of the request, whether or not to accept the request may be determined in accordance with the source of the request, as will be described hereinafter.

Figure 8:
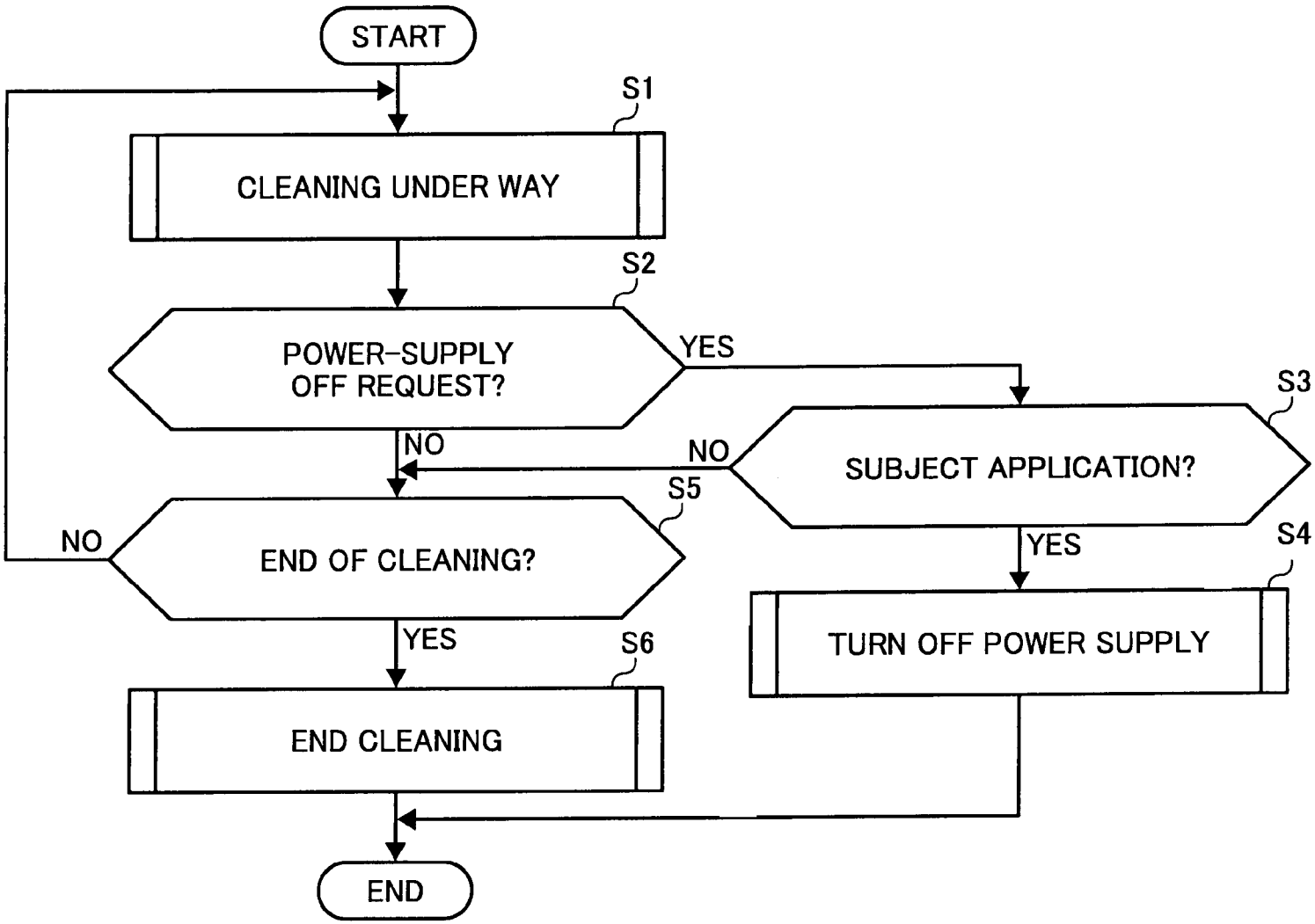

FIG. 8 is a flowchart showing a cleaning operation executed in a fixing device included in a third embodiment of the present invention. As shown, when a power-supply OFF request is generated (YES, step S2) while a cleaning operation is under way (step S1), whether or not the source of the request is an application is determined (step S3). If the source is an application and if it is a subject application (YES, step S3), the power-supply OFF request is accepted (step S4). If the answer of step S2 is NO, then the cleaning operation is continued in the usual manner (steps S5 and S6).

Figure 9:
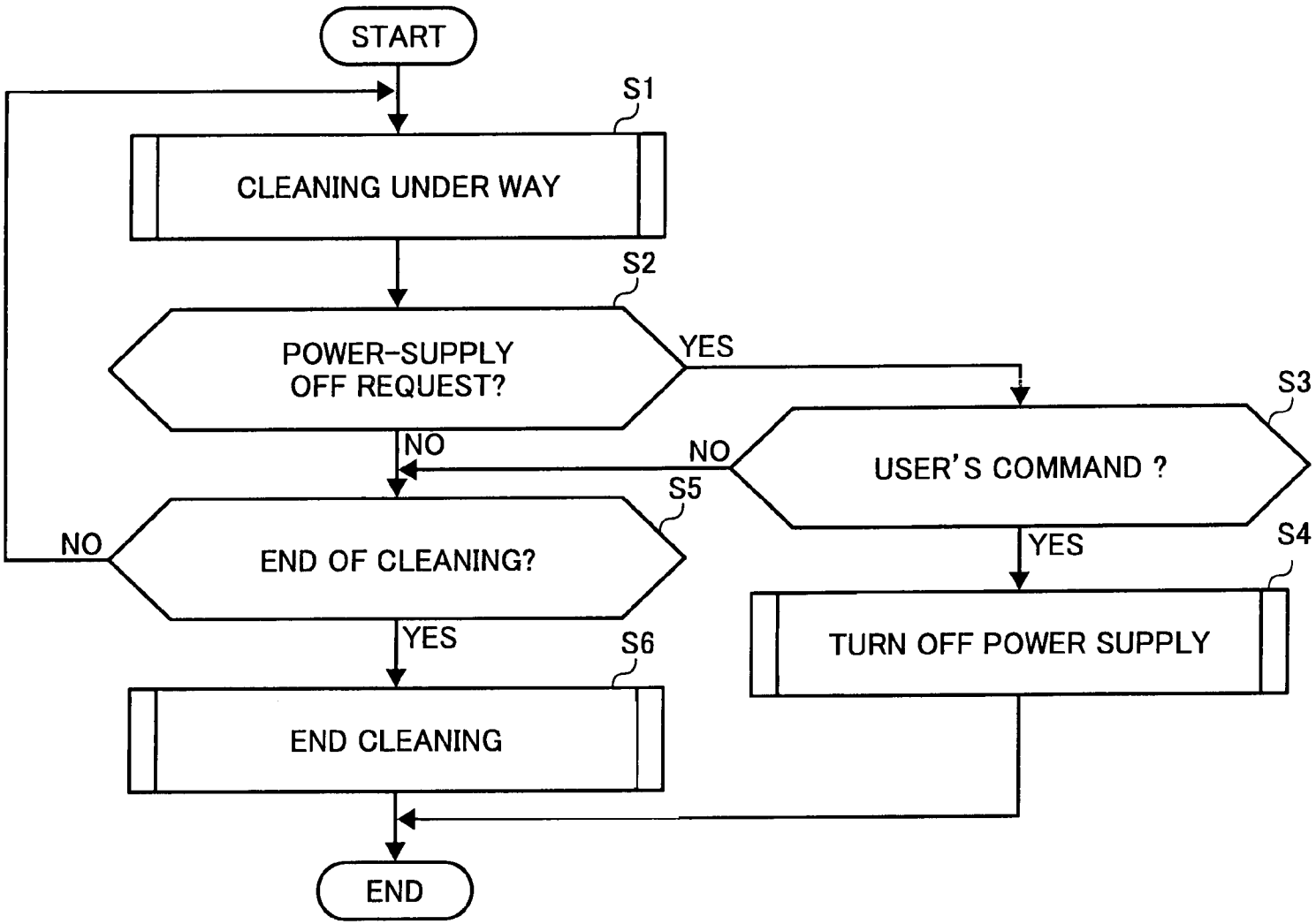

FIG. 9 is a flowchart showing a cleaning operation executed in a fixing device included in a fourth embodiment of the present invention. As shown, if a power-supply OFF request is generated by the user while a cleaning operation is under way (step 1) (YES, steps S2 and S3), the request is accepted (step S4). If the answer of the step S2 is NO, then the cleaning operation is continued in the usual manner (steps S5 and S6).

Figure 10:
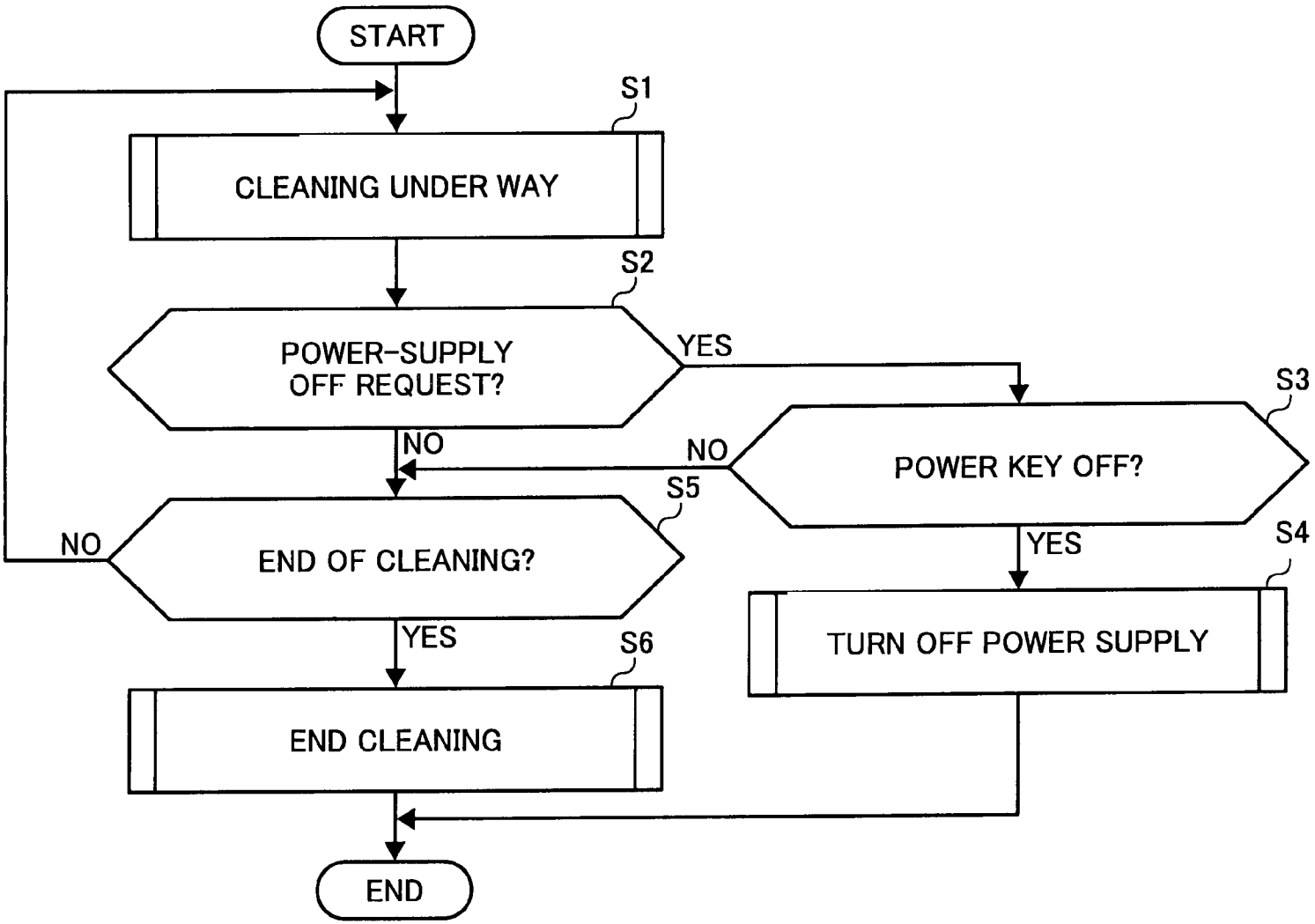

FIG. 10 is a flowchart showing a cleaning operation executed in a fixing device included in a fourth embodiment of the present invention. Generally, although a power-supply OFF request from the user may be sent via a network, it is difficult to arbitrate between a plurality of requests on a network. In light of this, the illustrative embodiment limits a power-supply OFF request to a power key provided on the image forming apparatus. As shown in FIG. 10, when the power key is in an OFF state, the power-supply OFF request is accepted (step S1, YES in step S2 and steps S3 and S4). If the answer of step S2 is NO, then the cleaning operation is continued in the usual manner (steps S5 and S6).

In summary, in an image forming apparatus including a fixing device in which a cleaning mechanism for collecting toner left on a heat roller is arranged, the present invention includes control means for causing, when a preselected number of prints are output after the end of a printing operation, the cleaning mechanism to clean the heat roller, and not accepting a power-supply OFF request generated during cleaning until the cleaning operation ends, thereby allowing the fixing device to surely execute the cleaning operation.

Various modifications will become possible for those skilled in the art after receiving the teachings of the present disclosure without departing from the scope thereof.

What is claimed is:

1. An image forming apparatus including a fixing device including a cleaning mechanism configured to collect toner left on a heat roller, said image forming apparatus comprising:

deciding means for determining that a preselected number of prints are output after a printing job; and control means for controlling a power-supply OFF operation in response to a power-supply OFF request;

wherein said control means postpones, when said deciding means determines that a cleaning operation for the heat roller should be executed and depending on a source of the power-supply OFF operation, the power-supply OFF operation indicated by the power-supply OFF request generated during the cleaning operation until said cleaning operation ends.

2. The apparatus as claimed in claim 1, wherein said control means displays on a control panel a message showing that the cleaning operation is under way.

3. The apparatus as claimed in claim 1, wherein said control means causes an external host to display a message showing that the cleaning operation is under way.

4. An image forming apparatus including a fixing device including a cleaning mechanism configured to collect toner left on a heat roller, said image forming apparatus comprising:

a deciding circuit configured to determine that a preselected number of prints are output after a printing job; and a control unit configured to control a power-supply OFF operation in response to a power-supply OFF request;

wherein said control unit postpone, when said deciding circuit determines that a cleaning operation for the heat roller should be executed and depending on a source of the power-supply OFF operation, the power-supply OFF operation indicated by the power-supply OFF request generated during the cleaning operation until said cleaning operation ends.

5. The apparatus as claimed in claim 4, wherein said control unit displays on a control panel a message showing that the cleaning operation is under way.

6. The apparatus as claimed in claim 4, wherein said control unit causes an external host to display a message showing that the cleaning operation is under way.

* * * * *